US009584922B2

(12) United States Patent
Hori et al.

(10) Patent No.: US 9,584,922 B2
(45) Date of Patent: Feb. 28, 2017

(54) HYBRID SPEAKER

(71) Applicant: FPS INC., Koto-ku, Tokyo (JP)

(72) Inventors: Masashi Hori, Tokyo (JP); Tohru Nakabayashi, Tokyo (JP); Yasuo Enokido, Tokyo (JP)

(73) Assignee: FPS INC., Tokyo (JP)

( * ) Notice: Subject to any disclaimer, the term of this patent is extended or adjusted under 35 U.S.C. 154(b) by 120 days.

(21) Appl. No.: 14/401,884

(22) PCT Filed: May 17, 2013

(86) PCT No.: PCT/JP2013/063799
§ 371 (c)(1),
(2) Date: Apr. 22, 2015

(87) PCT Pub. No.: WO2013/176053
PCT Pub. Date: Nov. 28, 2013

(65) Prior Publication Data

US 2015/0222995 A1 Aug. 6, 2015

(30) Foreign Application Priority Data

May 21, 2012 (JP) ..... 2012-115884
May 15, 2013 (JP) ..... 2013-103497

(51) Int. Cl.
*H04R 1/00* (2006.01)
*H04R 9/02* (2006.01)
(Continued)

(52) U.S. Cl.
CPC ..... *H04R 9/025* (2013.01); *H04R 7/04* (2013.01); *H04R 7/12* (2013.01); *H04R 7/18* (2013.01); *H04R 9/047* (2013.01)

(58) Field of Classification Search
CPC ..... H04R 9/025; H04R 2209/022; H04R 2209/024
See application file for complete search history.

(56) References Cited

U.S. PATENT DOCUMENTS 5,894,263 A * 4/1999 Shimakawa ..... G08B 6/00 340/384.1
8,615,102 B2 * 12/2013 Marugami ..... H04R 9/025 381/398

(Continued)

FOREIGN PATENT DOCUMENTS

JP 2000023439 1/2000
JP 2005318133 11/2005

(Continued)

OTHER PUBLICATIONS

International Search Report and Written Opinion in International Application No. PCT/JP2013/063799 mailed Jun. 18, 2013, 7 pages.

*Primary Examiner* — Ryan Robinson
(74) *Attorney, Agent, or Firm* — Thomas | Horstemeyer, LLP

(57) ABSTRACT

A hybrid speaker is provided. The hybrid speaker can include first magnets, second magnets, a yoke that accommodates the first and second magnets, a diaphragm, voice coils fixed at one face of the diaphragm, a frame, and a plate spring resiliently supporting the yoke at the frame. The first magnets can be arranged at predetermined intervals such that south poles or north poles thereof are oriented to the same side. The second magnets can have smaller volumes than the first magnets and be arranged singly or plurally between the first magnets their magnetic poles oriented the opposite those of the first magnets. The voice coils can be disposed so as to cross magnetic circuits between the first magnets and the yoke. The diaphragm can be fixed to the frame at periphery portions of the face at the side of the diaphragm at which the voice coils are fixed.

7 Claims, 17 Drawing Sheets

(51) Int. Cl.

| | |
|---|---|
| ***H04R 7/04*** | (2006.01) |
| ***H04R 7/12*** | (2006.01) |
| *H04R 7/18* | (2006.01) |
| *H04R 9/04* | (2006.01) |

(56) References Cited

U.S. PATENT DOCUMENTS

| | | | | |
|---|---|---|---|---|
| 2002/0021821 | A1* | 2/2002 | Tanase | H04R 9/025 381/431 |
| 2005/0031153 | A1* | 2/2005 | Nguyen | H04R 9/025 381/414 |
| 2012/0177247 | A1* | 7/2012 | Li | H04R 9/025 381/412 |
| 2014/0270326 | A1* | 9/2014 | Croft, III | H04R 9/025 381/398 |
| 2015/0010195 | A1* | 1/2015 | Croft, III | H01F 7/0289 381/398 |
| 2015/0110339 | A1* | 4/2015 | Colich | H04R 3/00 381/424 |

FOREIGN PATENT DOCUMENTS

| | | |
|---|---|---|
| JP | 2011502456 | 1/2011 |
| WO | WO0078095 | 12/2000 |
| WO | WO2009096242 | 8/2009 |
| WO | WO2010067531 | 6/2010 |
| WO | WO2011077770 | 6/2011 |
| WO | WO2011122528 | 10/2011 |

* cited by examiner

HYBRID SPEAKER

TECHNICAL FIELD

The present invention relates to a hybrid speaker combining a speaker function that produces sounds from a diaphragm with an actuator function that transmits vibrations to a speaker panel, to which the speaker is attached, so as to simultaneously produce sounds from the speaker panel. The present invention particularly relates to a hybrid speaker that, although compact, provides powerful high-pitched, medium pitched and low pitched sounds.

BACKGROUND ART

A composite speaker (see the specification of WO2011/077770) emits sounds from both a diaphragm and a speaker panel. The composite speaker is provided with: a plural number of magnets arranged at a predetermined interval; a yoke that forms magnetic circuits with the magnets, with magnetic gaps; voice coils that are disposed so as to cross magnetic circuits between the magnets and between the magnets and the yoke; a diaphragm, at one face of which the voice coils are secured; a frame that supports the diaphragm at periphery portions of the diaphragm and that accommodates the magnets and the yoke; the speaker panel, to which the frame is secured at a side of the frame that is opposite to the side thereof that supports the diaphragm; and a resilient member provided between the speaker panel and the yoke.

In the composite speaker recited in WO 2011/077770, the diaphragm emits high pitched sounds and the speaker panel emits medium and low pitched sounds. Thus, auditory localization is possible and the composite speaker has rich medium and low pitched sound components.

SUMMARY OF INVENTION

In recent years, there have been calls for hybrid speakers whose efficiency is more excellent than composite speakers and whose fabrication costs are low.

An object of the present invention is to provide a hybrid speaker that provides more powerful high sounds and medium and low sounds than the composite speaker recited in Patent Reference 1, and that is competitive in price.

A first aspect of the present invention relates to a hybrid speaker including: first magnets that are arranged at predetermined intervals such that one of south poles or north poles thereof are oriented to the same side; second magnets that have smaller volumes than the first magnets and that are arranged singly or in pluralities between the first magnets such that the magnetic poles thereof are oriented the opposite way to the first magnets; a yoke that accommodates the first and second magnets and that forms magnetic circuits with the first magnets; a voice coil that is disposed so as to cross magnetic circuits between the first magnets and the second magnets and between the first magnets and the yoke; a diaphragm, at one face of which the voice coil is fixed; a frame, to which the diaphragm is fixed at periphery portions of the face at the side of the diaphragm at which the voice coil is fixed; and a yoke support member that resiliently supports the yoke at the frame, at a face of the frame that is at the opposite side thereof from the side at which the diaphragm is fixed.

This hybrid speaker has a structure in which the first magnets and the second magnets with smaller volumes than the first magnets are arranged in a row such that the magnetic poles thereof are opposite. Therefore, magnetic fields produced between the first magnets and the second magnets are more intense than in a structure in which first magnets and second magnets have the same volume and are arranged at intervals.

Therefore, a larger diaphragm driving force can be generated by sound signals with the same strength flow in the voice coil.

Further, because the yoke is resiliently supported at the face that is at the opposite side of the frame from the side thereof at which the diaphragm is fixed, when a sound signal flows in the voice coil, as well as the diaphragm vibrating, the magnets and the yoke vibrate; the diaphragm and the yoke vibrate in anti-phase. The diaphragm is disposed such that the voice coil is placed at an aperture portion of the frame, the diaphragm being fixed to the frame at the outer side relative to the aperture portion of the frame. Therefore, when the frame is fixed to a speaker panel that includes an aperture portion that corresponds with the frame aperture portion, a region of the diaphragm at the inner side of the frame aperture portion functions as a diaphragm with a size corresponding to the frame aperture portion, and a region of the diaphragm at the outer side relative to the frame aperture portion functions as an actuator that causes the speaker panel to vibrate. Thus, high sounds are directly emitted from the diaphragm. For medium and low sounds, in addition to vibrations of the diaphragm, vibrations of the yoke are reversed in phase by the yoke support member and transmitted to the panel via the frame and the diaphragm. Therefore, powerful high sounds and medium and low sounds are produced.

A second aspect of the present invention relates to the hybrid speaker of the first aspect wherein the yoke support member is a plate spring of which one end is fixed to the yoke and the other end is fixed to the frame.

In this hybrid speaker, because the yoke support member is a plate spring, it is simple to specify a spring coefficient of the yoke support member, and functioning is reliable.

A third aspect of the present invention relates to the hybrid speaker of the second aspect wherein the plate spring is fixed to the yoke by the one end of the plate spring being nipped by a plate spring holding member and an end portion of the yoke, and the plate spring holding member is formed so as to protrude from the end portion of the yoke toward the other end portion of the plate spring.

In this hybrid speaker, the plate spring holding member is formed so as to protrude from the end portion of the yoke toward the other end portion of the plate spring. Therefore, the effective length of the plate spring differs between when the yoke moves in the direction approaching the diaphragm and when the yoke moves in the direction away from the diaphragm. When the yoke moves in the direction approaching the diaphragm, the effective length of the plate spring is shorter and deformation of the plate spring is suppressed.

Therefore, even when large sound signals are inputted into the voice coil, contact between the magnets and the voice coil and the production of abnormal sounds can be prevented. Moreover, an air gap between the voice coil and the first and second magnets may be made smaller. Therefore, larger acoustic pressures can be provided even when sound signals of the same magnitude are inputted.

A fourth aspect of the present invention relates to the hybrid speaker of any one of the first to third aspects wherein a shape in plan view of the diaphragm is a high-order curve represented by the following expression in an X-Y coordinate system whose origin is a central point of the diaphragm:

$$r^i = |x|^i + |y|^i$$

(in which r represents a radius and i represents an integer from 5 to 7),

In this hybrid speaker, the diaphragm has a plan view shape that is a semi-stadium shape with an outline that is a fifth- to seventh-order curve. Therefore, when the diaphragm and the magnets vibrate, strongly chaotic irregular vibrations are caused. Thus, degeneration does not occur and the characteristic frequency distribution follows a Wigner distribution.

Thus, a hybrid speaker is provided that may reproduce both medium and low sounds and high sounds more faithfully than in a case in which a diaphragm has a plan view shape other than the plan view shape described above.

According to one aspect of the present invention as described herein, because functioning of the spring is reliable and a face of the hybrid speaker at which the diaphragm is disposed is placed on the panel, more powerful high sounds and medium and low sounds are provided relative to the composite speaker recited in WO 2011/077770; and because the volume of the magnets is reduced, a hybrid speaker whose fabrication costs are inexpensive is provided.

DESCRIPTION OF EMBODIMENTS

1. First Exemplary Embodiment

Figure 1:
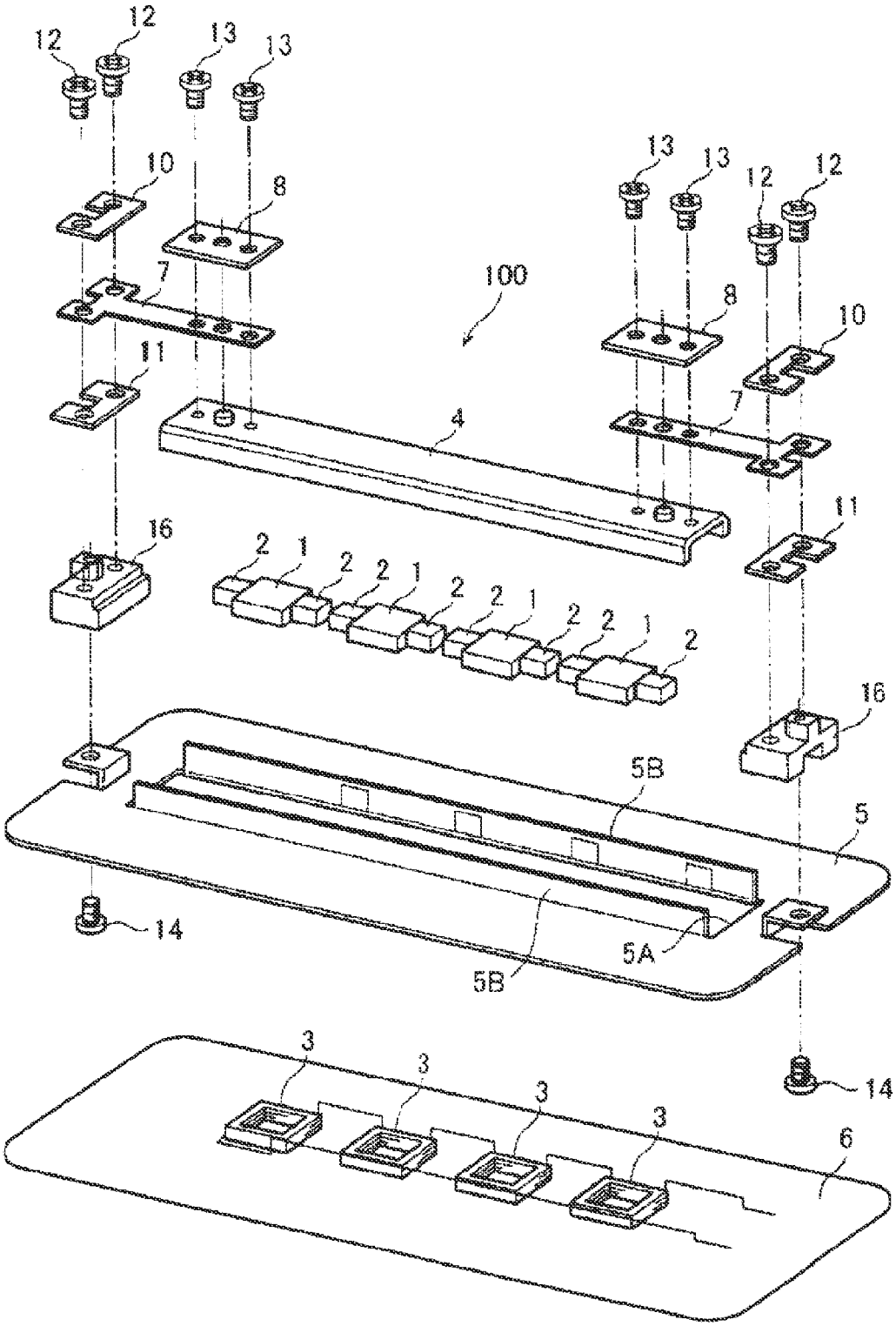
FIG. 1 is an exploded perspective view showing the structure of a hybrid speaker in accordance with a first exemplary embodiment.

Herebelow, examples of the hybrid speaker of the present invention are described in detail with reference to the drawings.

—Structure—

As shown in FIG. 1 to FIG. 5, a hybrid speaker 100 according to the first exemplary embodiment includes four first magnets 1 arranged in a straight line at equal intervals, and second magnets 2 that are arranged in pairs on a straight line between the first magnets 1. The second magnets 2 have smaller volumes than the first magnets 1. The first magnets 1 and second magnets 2 are accommodated inside a trough-shaped yoke 4. Magnetic circuits are formed between the first magnets 1 and second magnets 2 and between the first magnets 1 and the yoke 4. Four voice coils 3 are disposed so as to cross the magnetic fields. The four voice coils 3 are fixed to one face of a diaphragm 6. The diaphragm 6 is fixed to a frame 5 at periphery portions of a face of the diaphragm 6 at the side thereof at which the voice coils 3 are fixed. The yoke 4 is resiliently supported at the frame 5 by plate springs 7, which serve as a yoke support member, on a face of the frame 5 at the opposite side thereof to the side on which the diaphragm 6 is fixed.

As shown in FIG. 1 to FIG. 3, FIG. 5 and FIG. 6, the yoke 4 is formed of a ferromagnetic material and is a member with a trough shape that extends in the direction in which the first magnets 1 and second magnets 2 are arranged. The yoke 4 is supported at the frame 5 such that an opening portion thereof is oriented downward in FIG. 1, which is to say such that the opening portion opposes the diaphragm 6, which is to further say that a floor portion of the yoke 4 is oriented upward in FIG. 1.

Figure 5:
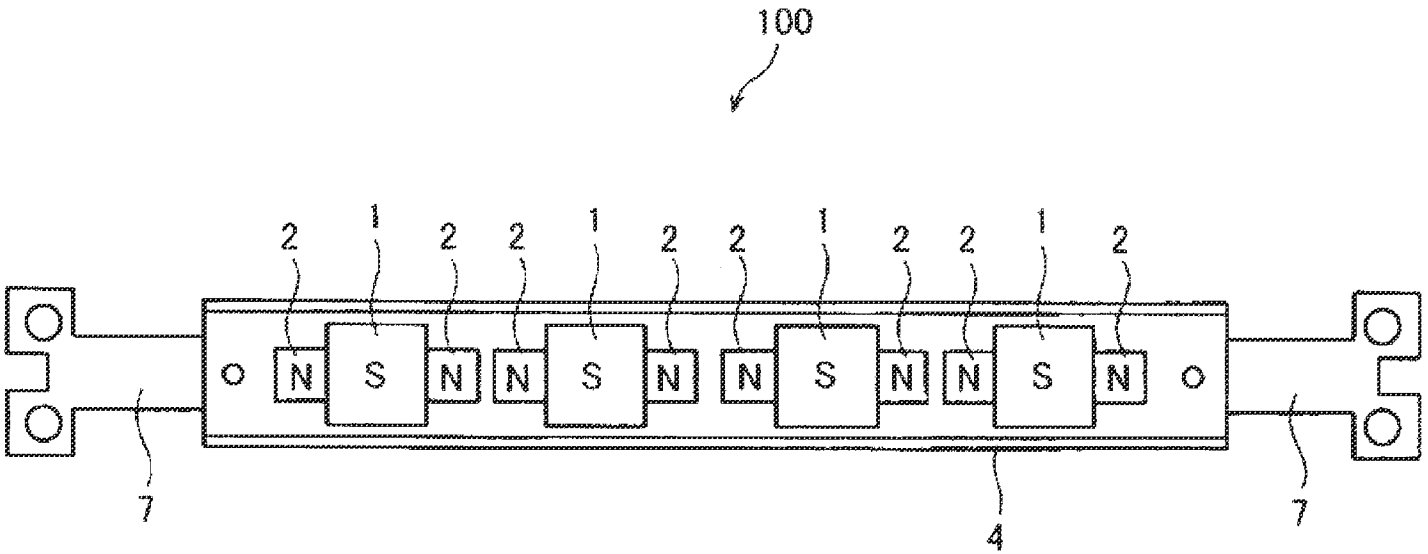
FIG. 5 is a plan view in which an example of an arrangement of first and second magnets inside the yoke of the hybrid speaker in accordance with the first exemplary embodiment is seen from below.
Figure 6:
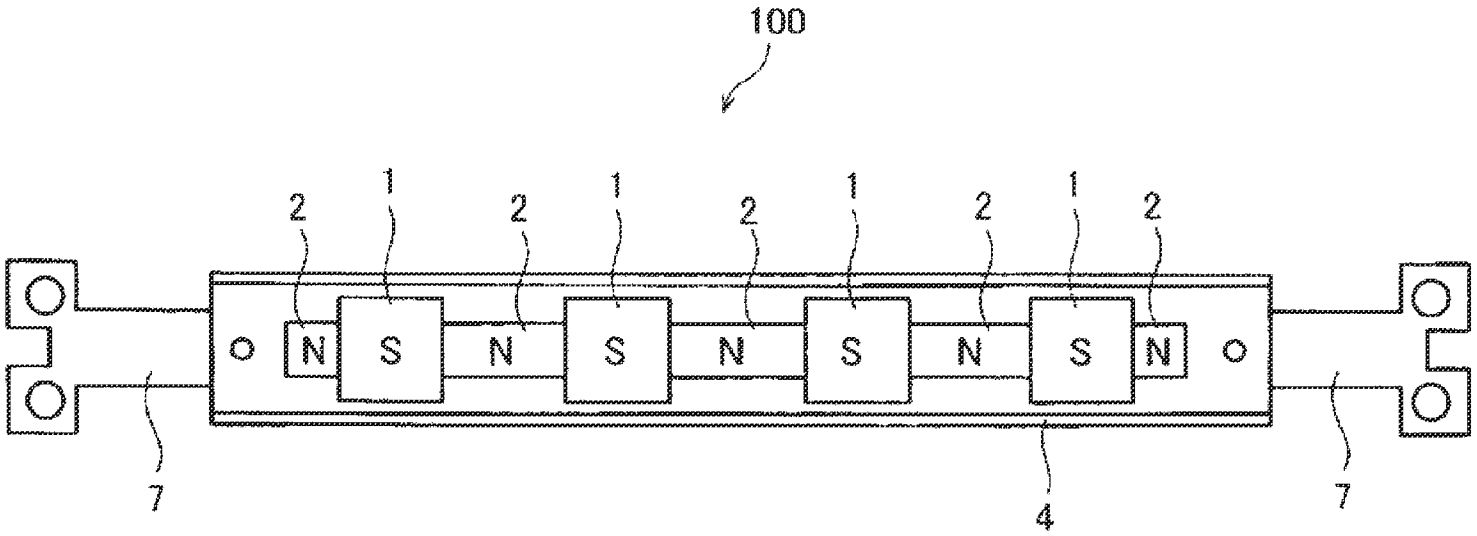
FIG. 6 is a plan view in which an alternative example of the arrangement of first and second magnets inside the yoke of the hybrid speaker in accordance with the first exemplary embodiment is seen from the below.

As shown in FIG. 5, the first magnets 1 and second magnets 2 are arranged inside the yoke 4, two of the second magnets 2 for one of the first magnets 1, such that the second magnets 2 sandwich the first magnets 1. The first magnets 1 and second magnets 2 are arranged such that the south poles of the first magnets 1 are oriented downward and the north poles of the second magnets 2 are oriented downward. Thus, in the state in which the yoke 4 is supported at the frame 5, the south poles of the first magnets 1 relatively oppose the voice coils 3. Instead of arranging the second magnets 2 in pairs so as to sandwich the first magnets 1, the second magnets 2 may be singly arranged between the first magnets 1, as shown in FIG. 6.

Regarding the volumes of the first magnets 1 and second magnets 2, if the volume of each first magnet 1 is represented by V and the volume of each second magnet 2 is represented by v, it is preferable if the relationship therebetween is $\frac{1}{2} \geq v/V \geq \frac{1}{5}$. Therefore, if a length×width×thickness of the first magnet 1 is 10 mm×10 mm×3 mm, a Length×width×thickness of the second magnet 2 of around 5 mm×5 mm×3 mm is preferable. As shown in FIG. 6, in a case in which the second magnets 2 are singly arranged between the first magnets 1, a length×width×thickness of the second magnet 2 of around 5 mm×10 mm×3 mm is preferable.

Figure 2:
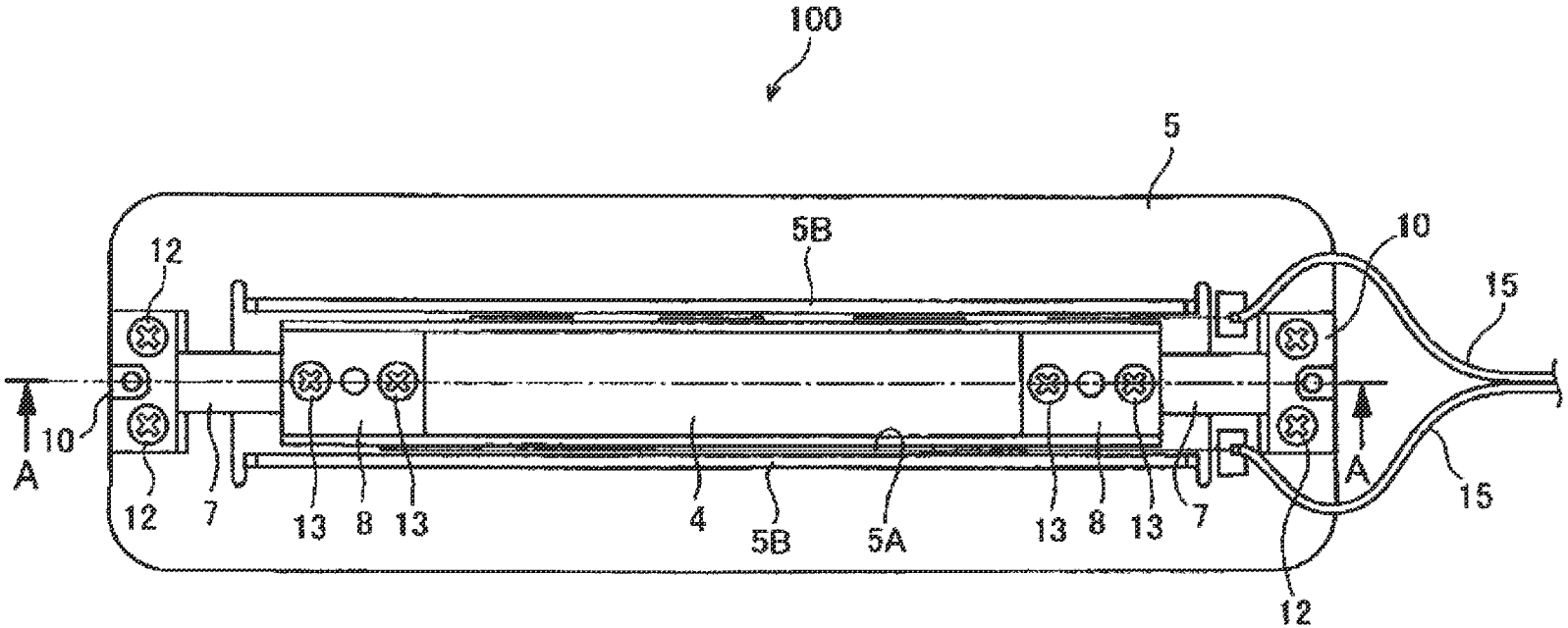
FIG. 2 is a plan view in which the hybrid speaker in accordance with the first exemplary embodiment is seen from a side thereof at which a yoke is disposed.
Figure 3:
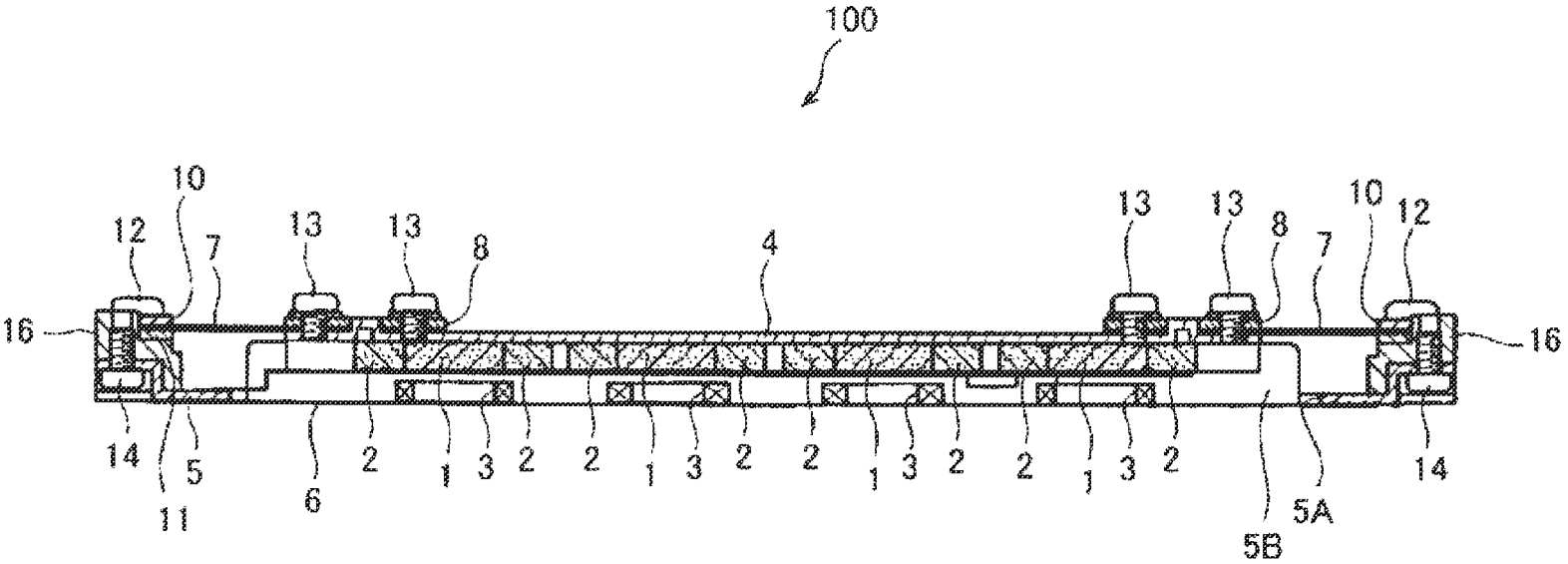
FIG. 3 is a sectional view showing a section in which the hybrid speaker in accordance with the first exemplary embodiment is cut along plane A-A of FIG. 2.

As shown in FIG. 1 to FIG. 3, an aperture portion 5A in a long rectangular shape is formed in the frame 5 along the direction in which the first magnets 1 and second magnets 2 are arranged. The aperture portion 5A is for accommodating the yoke 4. Edge portions at each of two sides of the aperture portion 5A are inflected upward to form inflected portions 5B. The inflected portions 5B have a function of increasing stiffness of the frame 5. The diaphragm 6 is fixed to a face at the lower side of the frame 5 such that the voice coils 3 are disposed at the inner side of the aperture portion 5A of the frame 5. The diaphragm 6 may be fixed to the lower face of the frame 5 by adhesion, and may be fixed by double-sided adhesive tape.

Suspension blocks 16 are fixed by screws 14 to central portions of the short sides of the upper side face of the frame 5. One end portions of the plate springs 7 are fixed to end portions of the yoke 4 and other end portions of the plate springs 7 are fixed to the suspension blocks 16. In a state in which the other end portion of each plate spring 7 is nipped by a spacer 11 and a plate spring holding member 10, the other end portion of the plate spring 7 is fixed to an upper face of the suspension block 16 by screws 12. In FIG. 2, the reference symbol 15 indicates leads for inputting sound signals to the voice coils 3.

Figure 4:
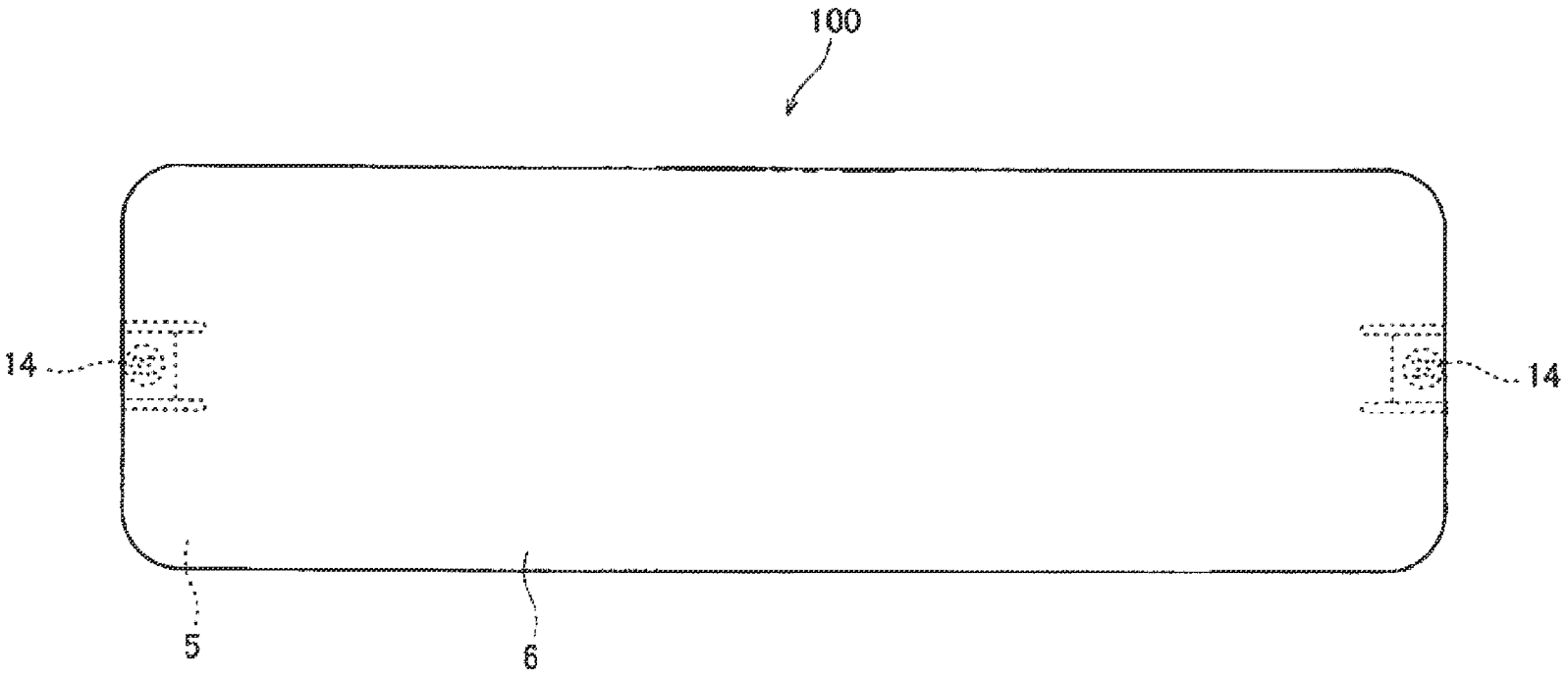
FIG. 4 is a plan view in which the hybrid speaker in accordance with the first exemplary embodiment is seen from a side thereof at which a diaphragm is disposed.

As shown in FIG. 4, the diaphragm 6 preferably has substantially the same shape in plan view as the shape in plan view of the frame 5 and has a configuration of entirely covering the lower face of the frame 5. The diaphragm 6 and the frame 5 preferably have a plan-view shape of high-order curves represented by the following expression, in an X-Y coordinate system whose origin is a central point of the diaphragm 6:

$$r^i = |x|^i + |y|^i$$

(in which r represents a radius and i represents an integer from 5 to 7), since a hybrid speaker having the diaphragm 6 and the frame 5 having a shape of high-order curves having an order of 5 to 7 would produce high pitched sounds as well as medium and low pitched sounds more faithfully than a hybrid speaker having the diaphragm 6 and the frame 5 not in a shape of a fifth to seventh order high-order curves.

—Operation—

Herebelow, operation of the hybrid speaker 100 is described.

As described above, the south poles of the first magnets 1 and the north poles of the second magnets 2 are arranged inside the yoke 4 so as to oppose the diaphragm 6. Therefore, lines of magnetic force from the first magnets 1 to the second magnets 2 are generated. Lines of magnetic force are also generated between the first magnets 1 and the yoke 4.

The voice coils 3 are fixed to the face at the upper side of the diaphragm 6 so as to oppose the first magnets 1. Therefore, windings of the voice coils 3 cross the lines of magnetic force between the first magnets 1 and the second magnets 2 and the lines of magnetic force between the first magnets 1 and the yoke 4.

Thus, when sound signals are inputted to the voice coils 3, varying magnetic fields are produced at the voice coils 3. The varying magnetic fields interact with the lines of magnetic force from the first magnets 1 to the second magnets 2 and the lines of magnetic force between the first magnets 1 and the yoke 4, and the diaphragm 6 vibrates.

The first magnets 1 and the second magnets 2 with smaller volumes than the first magnets 1 are arranged in a straight line, and the second magnets 2 are arranged singly or in pairs between the first magnets 1. Therefore, more intense lines of magnetic force are produced between the first magnets 1 and second magnets 2 than if the first magnets 1 and second magnets 2 had the same volume and were spaced therebetween.

Figure 15:
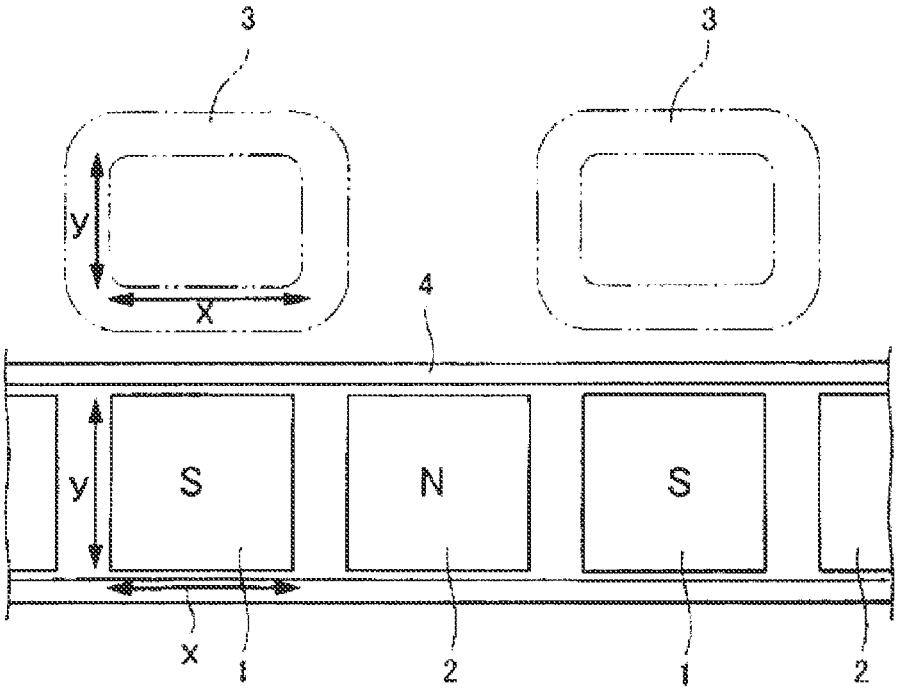
FIG. 15 is a descriptive diagram showing an A-format magnet array in which second magnets with the same volume as first magnets (the same thickness and area) are arranged between the first magnets.
Figure 16:
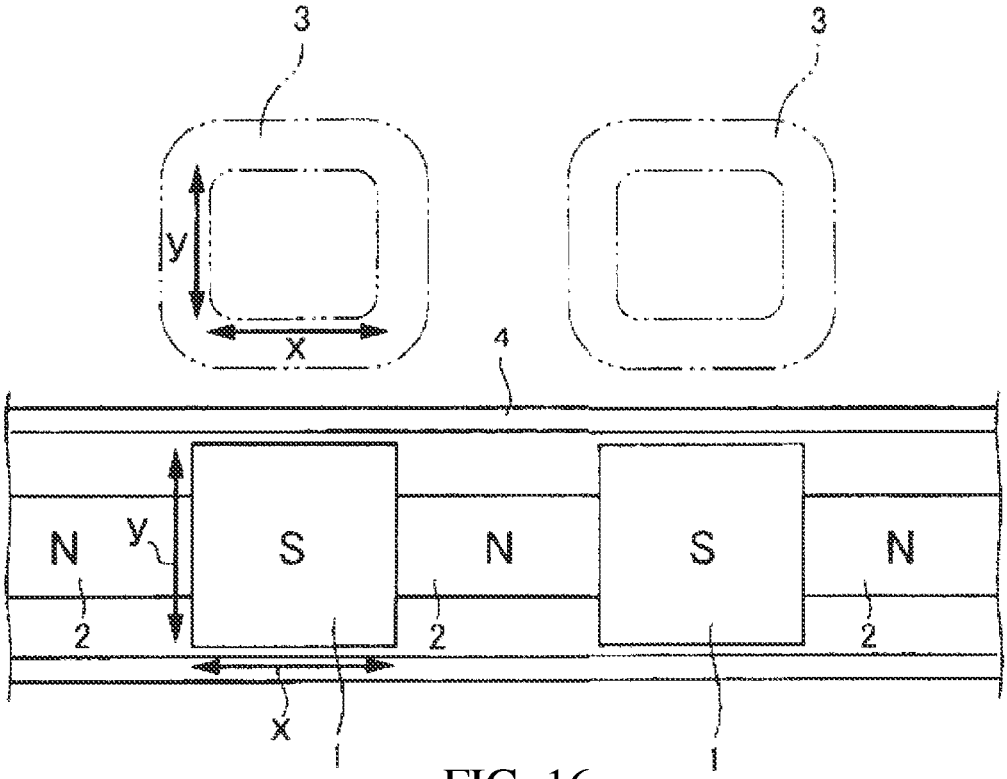
FIG. 16 is a descriptive diagram showing a B-format magnet array in which second magnets with smaller volumes than first magnets are arranged singly between the first magnets.
Figure 17:
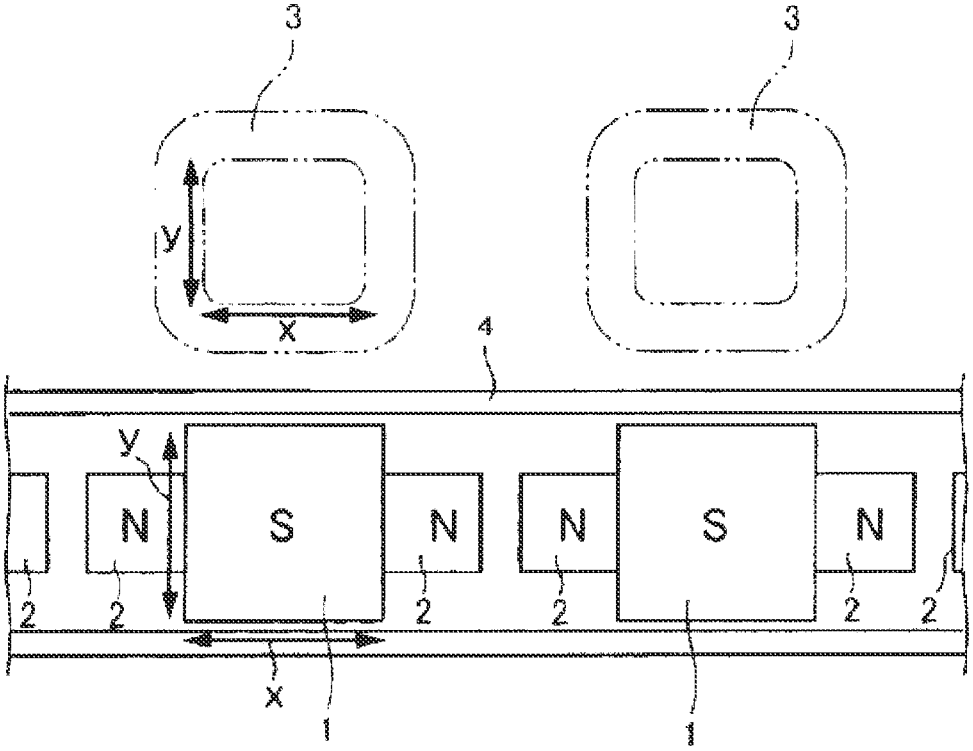
FIG. 17 is a descriptive diagram showing a C-format magnet array in which second magnets with smaller volumes than first magnets are arranged in pairs between the first magnets.
Figure 18:
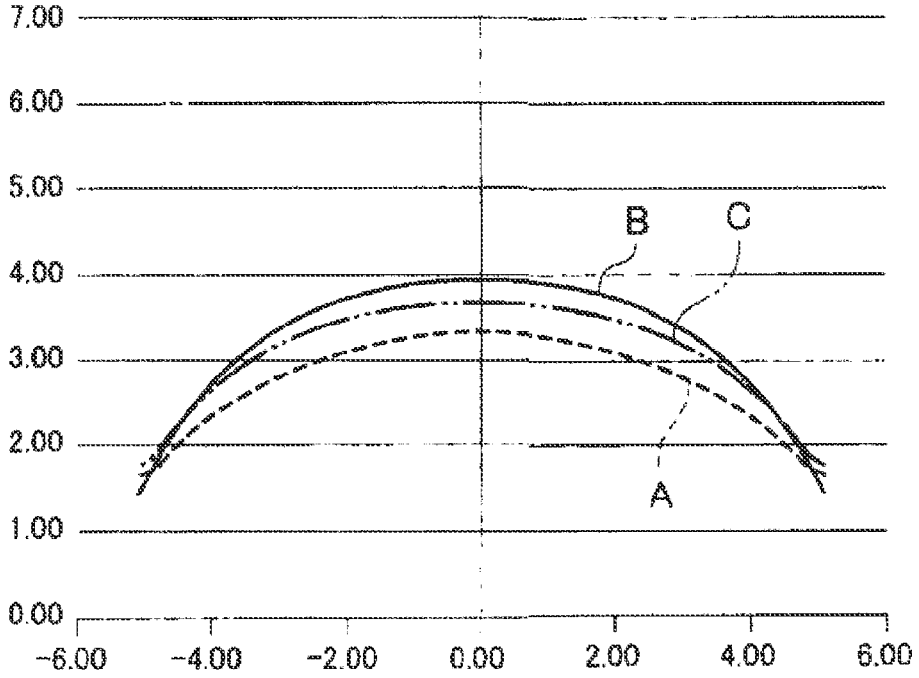
FIG. 18 is a graph showing horizontal magnetic forces of X components in FIG. 15 to FIG. 17 for the respective A-format, B-format and C-format magnet arrays.
Figure 19:
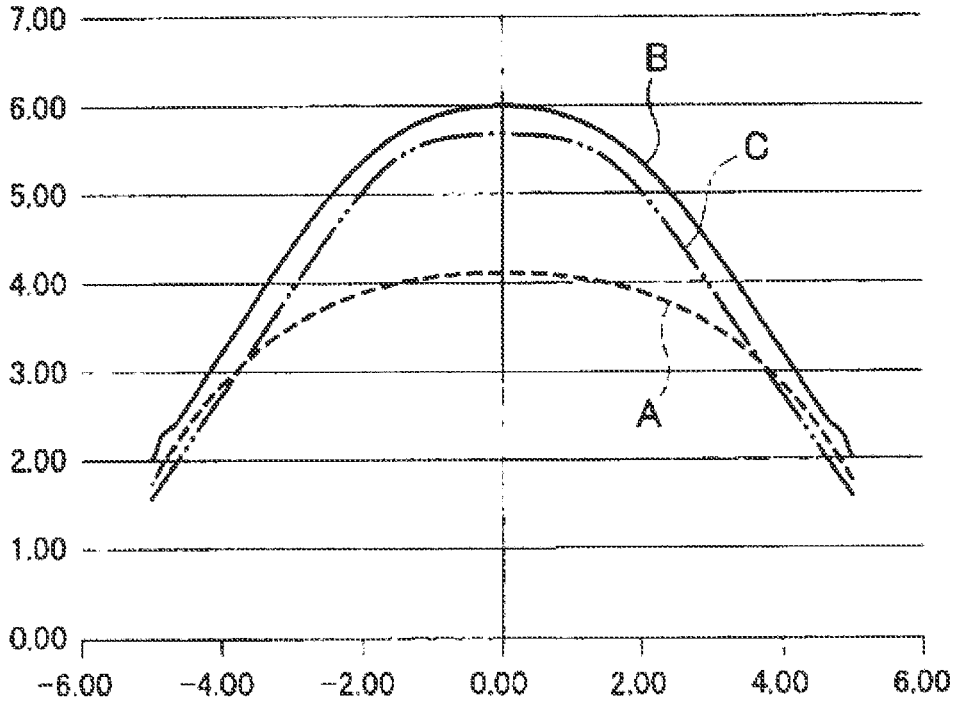
FIG. 19 is a graph showing horizontal magnetic forces of Y components in FIG. 15 to FIG. 17 for the respective A-format, B-format and C-format magnet arrays.

FIG. 18 and FIG. 19 illustrate results of measuring horizontal magnetic forces between the first magnets 1 and the yoke 4 (X components) and between the first magnets 1 and second magnets 2 (Y components) for each of an A-format magnet array shown in FIG. 15, a B-format magnet array shown in FIG. 16 and a C-format magnet array shown in FIG. 17. In the A format, the second magnets 2 have the same thickness and area, that is, the same volume, as the first magnets 1 and are arranged between the first magnets 1 inside the yoke 4. In the B format, the second magnets 2 have a smaller volume than the first magnets 1 and are arranged singly between the first magnets 1 inside the yoke 4. In the C format, the second magnets 2 have a smaller volume than the first magnets 1 and are arranged in pairs between the first magnets 1 inside the yoke 4. In FIG. 18 and FIG. 19, the vertical axes represent the horizontal magnetic forces of the X components and the Y components, and the horizontal axes represent distances (mm) of the first magnets 1 from the middle of the yoke 4.

From FIG. 18 and FIG. 19, it is understood that both the horizontal magnetic forces between the first magnets 1 and the yoke 4 and the horizontal magnetic forces between the first magnets 1 and the second magnets 2 exhibit higher values in the B-format and C-format magnet arrays than in the A-format magnet array. Falls in magnetic force at end portions of the first magnets 1 cannot be seen. In particular, as shown in FIG. 19, the horizontal magnetic forces between the first magnets 1 and second magnets 2 (the Y components) in the B-format and C-format magnet arrays are up to 1.5 times higher than in the A-format magnet array.

Therefore, in the hybrid speaker 100, even though the volume of the magnets is greatly reduced, the diaphragm 6 vibrates with greater amplitudes than if sound signals of the same magnitude were inputted to the voice coils 3 in a case in which the first magnets 1 and second magnets 2 have the same volumes.

In FIG. 18 and FIG. 19, if the B-format magnet array and the C-format magnet array are compared, horizontal magnetic forces in both the X direction and the Y direction are higher in the B-format magnet array. Moreover, arrangement of the first magnets 1 and second magnets 2 may be simpler in the B-format magnet array than in the C-format magnet array.

When sound signals are inputted to the voice coils 3, in addition to the diaphragm 6 vibrating, the yoke 4 vibrates, at the opposite phase from the diaphragm 6. However, because the yoke 4 is resiliently supported at the frame 5 via the suspension blocks 16 and the plate springs 7 fixed to the two ends of the yoke 4, the phase of the vibrations of the yoke 4 is reversed and the frame 5 is caused to vibrate in the same phase of the vibrations of the diaphragm 6.

Therefore, when the face at the side of the frame 5 at which the diaphragm 6 is fixed is placed on a panel with an aperture portion that corresponds with the aperture portion 5A of the frame 5, high pitched sounds are transmitted directly from the diaphragm 6 to the panel, and medium and low pitched sounds are transmitted to the panel by the vibrations of the diaphragm 6 synergistically with vibrations that are transmitted to the panel via the frame 5. Thus, more powerful high pitched sounds and medium and low pitched sounds can be provided.

The panel may be a fiber-molded board in which a fiber material is molded into a board shape, a wooden board, a metal board, a plastic board, a foam plastic board, a composite material of the above, or the like.

2. Second Exemplary Embodiment

Herebelow, alternative examples of the hybrid speaker of the present invention are described.

—Structure—

As shown in FIG. 7 to FIG. 11, a hybrid speaker 102 according to the second exemplary embodiment is similar to the hybrid speaker according to the first exemplary embodiment in being provided with: the trough-shaped yoke 4 that accommodates the alternately arranged first magnets 1 and second magnets 2 inside; the diaphragm 6, at one face of which the voice coils 3 are fixed; and the frame 5 to which the diaphragm 6 is fixed at periphery portions of the face at the side thereof at which the voice coils 3 are fixed, and that resiliently supports the yoke 4 via the plate springs 7.

Figure 7:
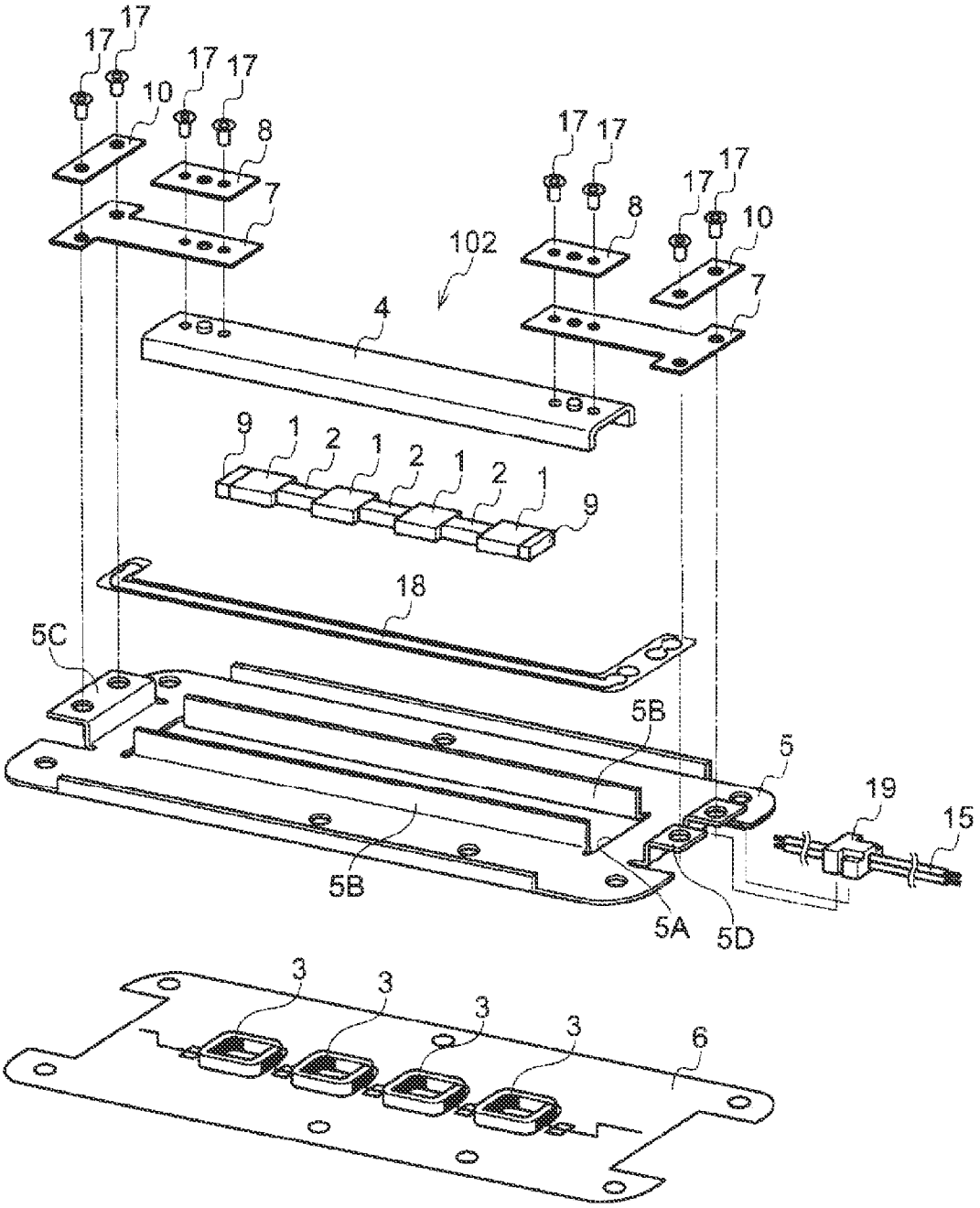
FIG. 7 is an exploded perspective view showing the structure of a hybrid speaker in accordance with a second exemplary embodiment.

As shown in FIG. 7, the yoke 4 is a trough-shaped member formed of a ferromagnetic material. The two end portions of the yoke 4 are attached to the frame 5, at a spring member attachment portion 5C and a spring member attachment portion 5D, via the plate springs 7, such that the opening portion of the yoke 4 is oriented downward in FIG. 7, which is to say such that the opening portion opposes the diaphragm 6.

Figure 11:
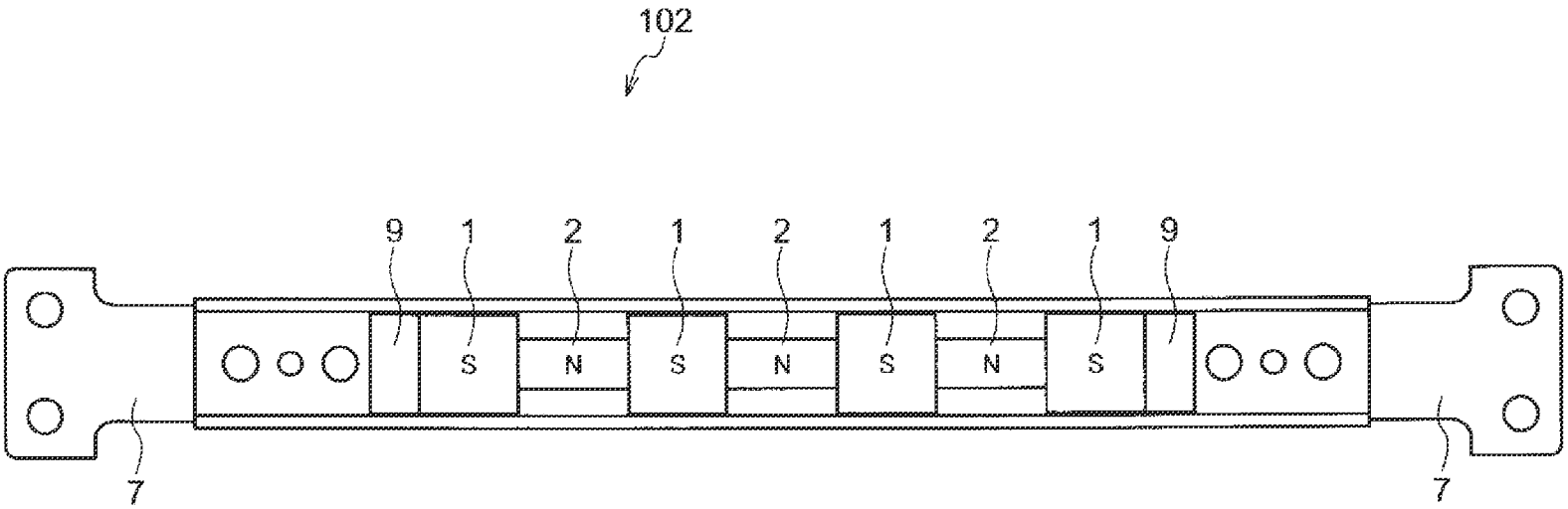
FIG. 11 is a plan view in which an example of an arrangement of first and second magnets inside the yoke of the hybrid speaker in accordance with the second exemplary embodiment is seen from below.
Figure 12:
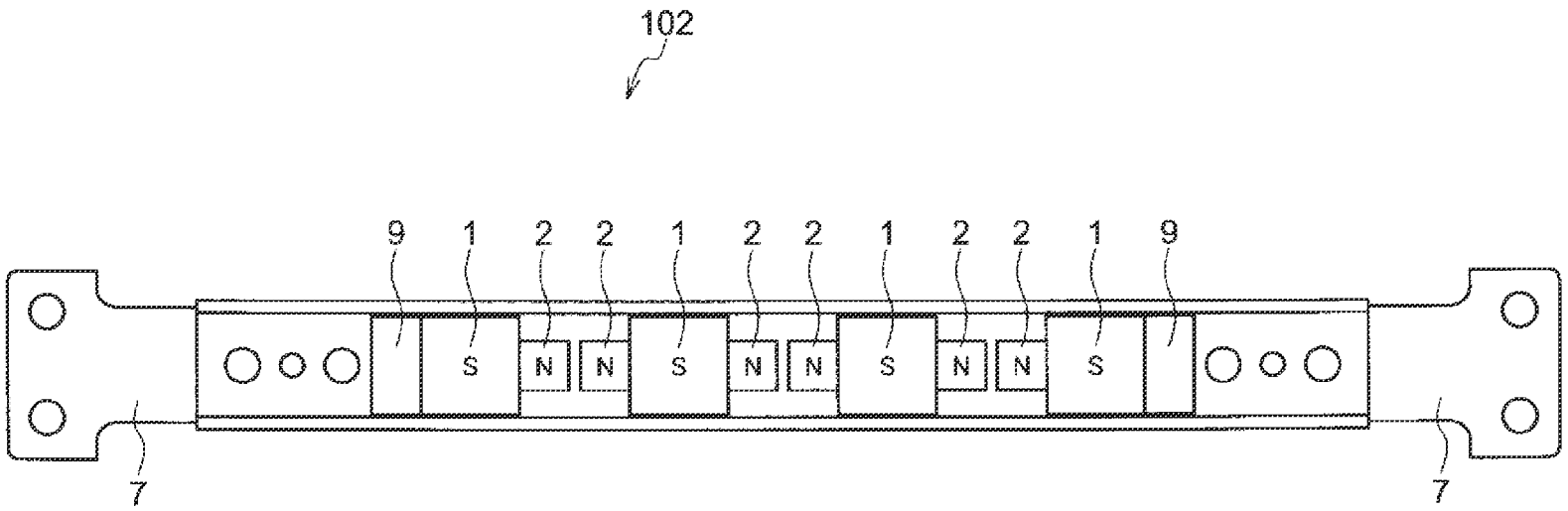
FIG. 12 is a plan view in which an alternative example of the arrangement of first and second magnets inside the yoke of the hybrid speaker in accordance with the second exemplary embodiment is seen from below.

As shown in FIG. 7 and FIG. 11, the first magnets 1 and second magnets 2 are alternately arranged inside the yoke 4 so as to be in close contact with one another. Positioning members 9 formed of a non-magnetic material are disposed at the two ends of the magnet row in which the first magnets 1 and second magnets are alternately arranged. Thus, in the example shown in FIG. 7 to FIG. 11, the magnets are arranged such that the south poles of the first magnets 1 are oriented downward, which is to say towards the side thereof at which the opening portion of the yoke 4 is disposed, and the north poles of the second magnets 2 are oriented downward, which is to say towards the side thereof at which the opening portion of the yoke 4 is disposed. Thus, in the state in which the yoke 4 is supported at the frame 5, the south poles of the first magnets 1 relatively oppose the voice coils 3. In the example shown in FIG. 7 to FIG. 11, four of the first magnets 1 and three of the second magnets are arranged. However, the numbers of the first magnets 1 and second magnets 2 are not limited to the numbers illustrated in FIG. 7 to FIG. 11. Moreover, instead of the second magnets 2 being singly arranged between the first magnets 1, the second magnets 2 may be arranged in pairs between the first magnets 1, as illustrated in FIG. 12. In a case in which the second magnets 2 are arranged in pairs between the first magnets 1 as illustrated in FIG. 12, it is preferable if the second magnets 2 are disposed in close contact with both sides of each first magnet 1.

Regarding the volumes of the first magnets 1 and the second magnets 2, if the volume of each first magnet 1 is represented by V and the volume of each second magnet 2 is represented by v, it is preferable if the relationship therebetween is $\frac{1}{2} \geq v/V \geq \frac{1}{5}$. Therefore, in the case of an arrangement as illustrated in FIG. 7 and FIG. 11 such that one of the second magnets 2 is sandwiched between two of the first magnets 1, it is preferable if the second magnet 2 has a dimension in the length direction of the magnet row and a thickness that are equal to the first magnet 1, while a dimension of the second magnet 2 in the width direction, which is to say a direction orthogonal to the length direction of the magnet row, is set to a smaller dimension than the first magnet 1. Thus, as an example, if the length×width×thickness of the first magnet 1 is 10 mm×10 mm×3 mm, a length×width×thickness of the second magnet 2 of around 5 mm×10 mm×3 mm is preferable.

In the case of an arrangement as illustrated in FIG. 12 such that pairs of the second magnet 2 are sandwiched between the first magnets 1, as an example, if the length×width×thickness of the first magnet 1 is 10 mm×10 mm×3 mm, a length×width×thickness of the second magnet 2 of around 5 mm×5 mm×3 mm is preferable.

Figure 8:
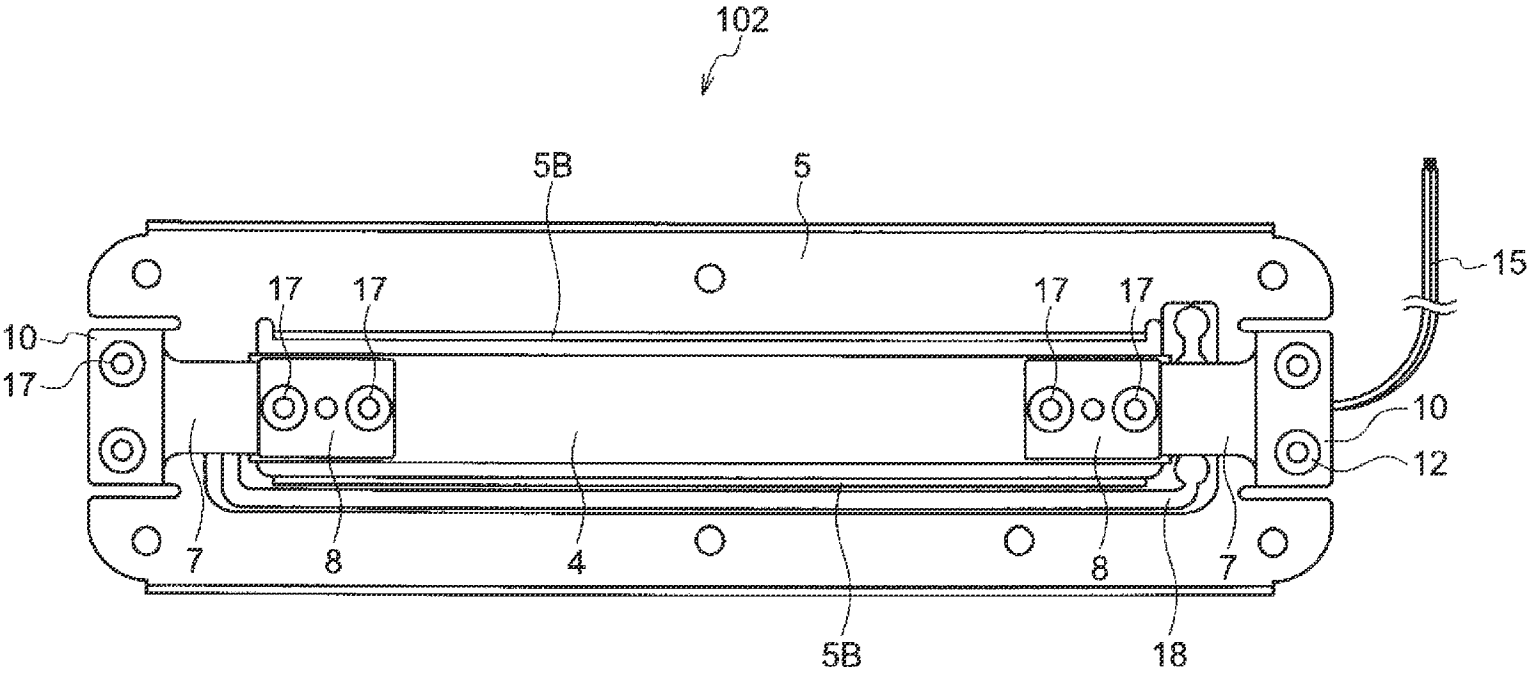
FIG. 8 is a plan view in which the hybrid speaker in accordance with the second exemplary embodiment is seen from the side thereof at which a yoke is disposed.
Figure 9:
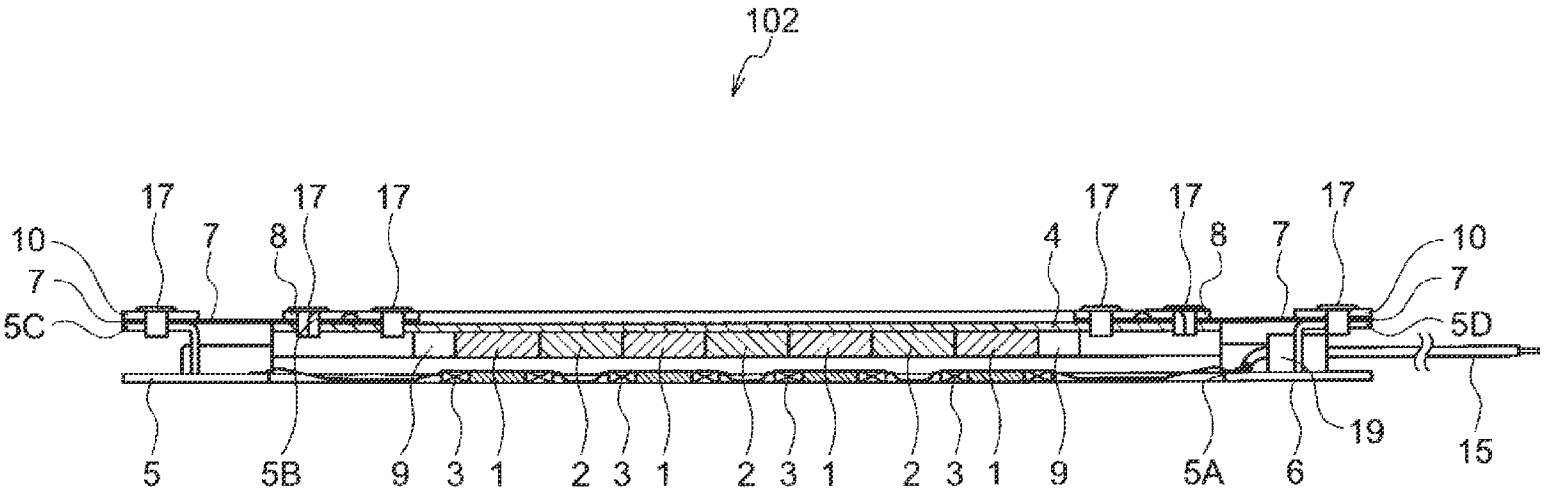
FIG. 9 is a sectional diagram showing a section in which the hybrid speaker in accordance with the second exemplary embodiment is cut along plane A-A of FIG. 2.
Figure 10:
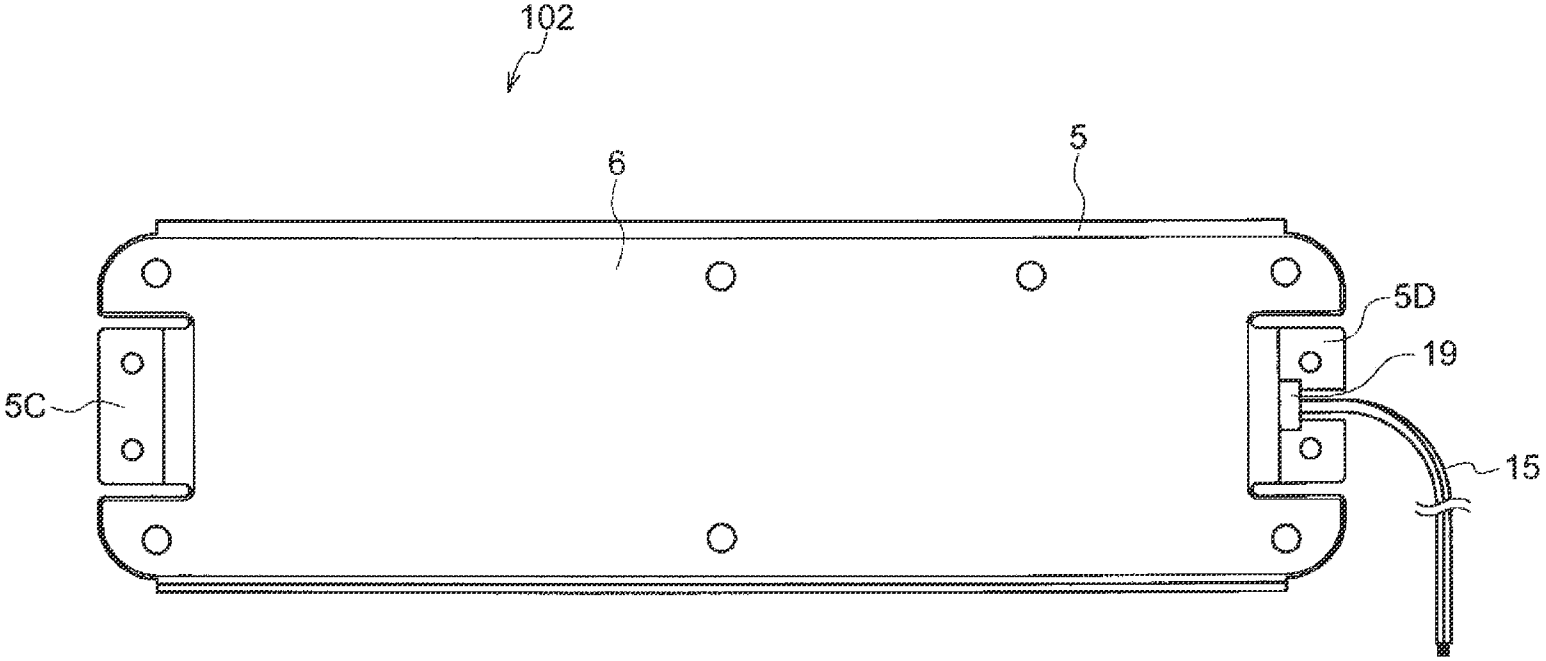
FIG. 10 is a plan view in which the hybrid speaker in accordance with the second exemplary embodiment is seen from the side thereof at which a diaphragm is disposed.

As shown in FIG. 7 to FIG. 9, the frame 5 overall has a plan view shape that is substantially a long rectangular shape with rounded vertices. The long rectangle-shaped aperture portion 5A for accommodating the yoke 4 is formed at a central portion of the frame 5, and the edge portions at the two sides of the aperture portion 5A are inflected upward to form the inflected portions 5B. The spring member attachment portion 5C and the spring member attachment portion 5D are formed at the central portions of the short sides of the frame 5, at the face at the upper side of the frame 5. The edges of the frame 5 do not necessarily have to be straight lines but may be curves that protrude to the outer sides.

The diaphragm 6 is fixed to the face at the side of the frame 5 that is opposite to the side thereof at which the inflected portions 5B, the spring member attachment portion 5C and the spring member attachment portion 5D are formed, which is to say the face at the lower side of the frame 5. The diaphragm 6 is fixed such that the voice coils 3 are disposed at the inner side of the aperture portion 5A of the frame 5. The diaphragm 6 may be fixed to the lower face of the frame 5 by adhesion, and may be fixed by double-sided adhesive tape.

As shown in FIG. 7 to FIG. 9, in a state in which the one end portions of the plate springs 7 are nipped by the end portions of the yoke 4 and plate spring holding members 8, the one end portions of the plate springs 7 are fixed by rivets 17. Correspondingly, in a state in which the other end portions of the plate springs 7 are nipped by the spring member attachment portions 5C and 5D and the plate spring holding members 10, the other end portions of the plate springs 7 are fixed to the upper faces of the spring member attachment portions 5C and 5D by the rivets 12. A cable bush 19 is fitted into and fixed to the spring member attachment portion 5D. The cable bush 19 prevents the leads 15 for inputting sound signals to the voice coils 3 from being pulled out by tension. The cable bush 19 is formed of a non-magnetic material such as plastic, synthetic rubber or the like. A flexible circuit board 18 that connects the leads 15 with the voice coils 3 is disposed on the upper face of the frame 5.

The diaphragm 6 is the same as described in the first exemplary embodiment.

—Operation—

The magnetic force intensifying effect caused by the first magnets 1 and second magnets 2 inside the yoke is the same as described in the section on "Operation" of the first exemplary embodiment.

In the hybrid speaker 102, when sound signals are inputted to the voice coils 3, in addition to the diaphragm 6 vibrating, the yoke 4 vibrates, at the opposite phase from the diaphragm 6. However, because the yoke 4 is resiliently supported at the spring member attachment portion 5C and spring member attachment portion 5D of the frame 5 via the plate springs 7 fixed at the two ends of the yoke 4, the phase of the vibrations of the yoke 4 is reversed and the frame 5 is caused to vibrate in the same phase of the vibrations of the diaphragm 6.

Therefore, when the face at the side of the frame 5 at which the diaphragm 6 is fixed is placed on the panel with the aperture portion that corresponds with the aperture portion 5A of the frame 5, high pitched sounds are transmitted directly from the diaphragm 6 to the panel, and medium and low pitched sounds are transmitted to the panel by vibrations of the diaphragm 6 synergistically with vibrations that are transmitted to the panel via the frame 5. Thus, more powerful high pitched sounds and medium and low pitched sounds can be provided.

As in the hybrid speaker 100 according to the first exemplary embodiment, a fiber-molded board in which a fiber material is molded into a board shape, a wooden board, a metal board, a plastic board, a foam plastic board, a composite material of the above, or the like may be employed as the panel.

In addition, in the hybrid speaker 102 according to the second exemplary embodiment, the one end portions of the plate springs 7 are fixed to the yoke 4 not by screws 13 but by the rivets 17. Further, the other end portions of the plate springs 7 are fixed to the spring member attachment portions 5C and 5D formed at the frame 5 by the rivets 17 instead of the screws 12. Thus, slackness between the plate springs 7 and the yoke 4 and frame 5 after use over a long period may be prevented.

3. Third Exemplary Embodiment

Herebelow, a further alternative example of the hybrid speaker of the present invention is described with reference to FIG. 13. Reference symbols in FIG. 13 that are the same as in FIG. 1 to FIG. 6 indicate structural elements that are the same as those indicated by the reference symbols in FIG. 1 to FIG. 6, unless otherwise noted.

Figure 13:
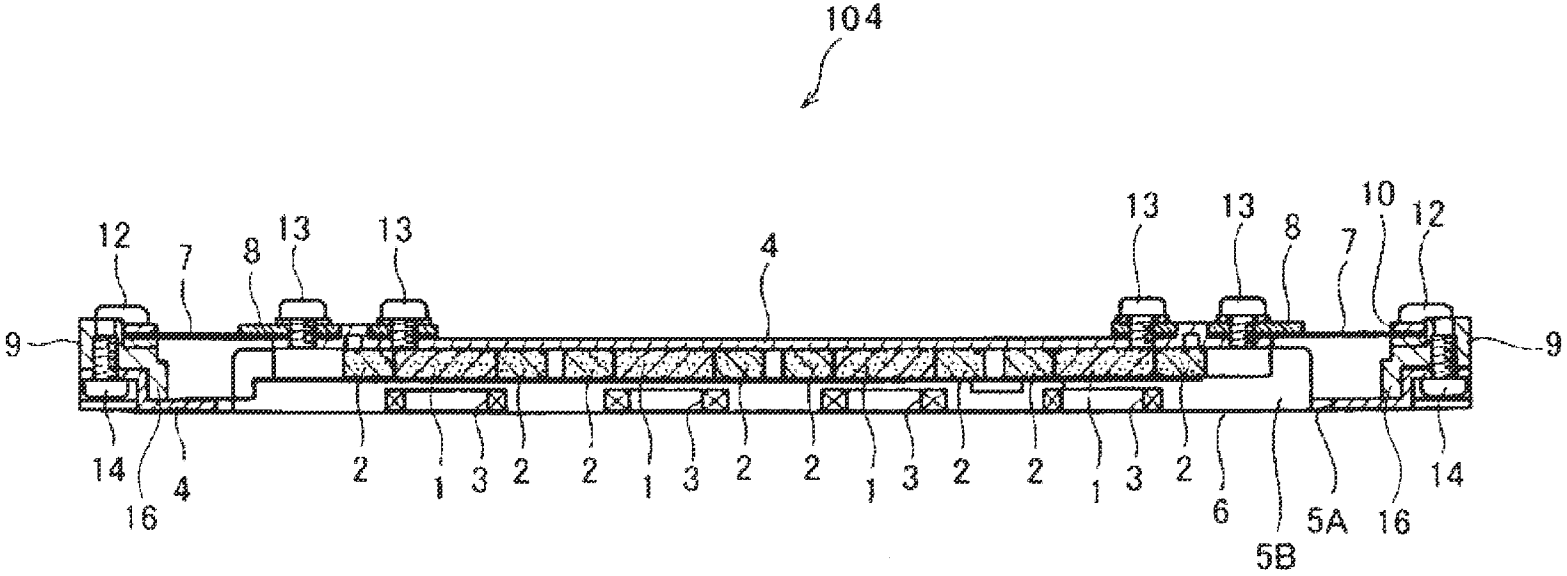
FIG. 13 is a sectional diagram showing a section in which a hybrid speaker in accordance with a third exemplary embodiment is cut along a plane in a length direction.

As shown in FIG. 13, a hybrid speaker 104 according to the third exemplary embodiment has a structure in which each plate spring holding member 8, at the side thereof that nips the one end of the plate spring 7 against the yoke 4, protrudes from the end portion of the yoke 4 toward the side at which the other end of the plate spring 7 is disposed, which is to say toward the end portion of the plate spring 7 at the side thereof that is fixed to the frame 5 via the suspension block 16.

Figure 14:
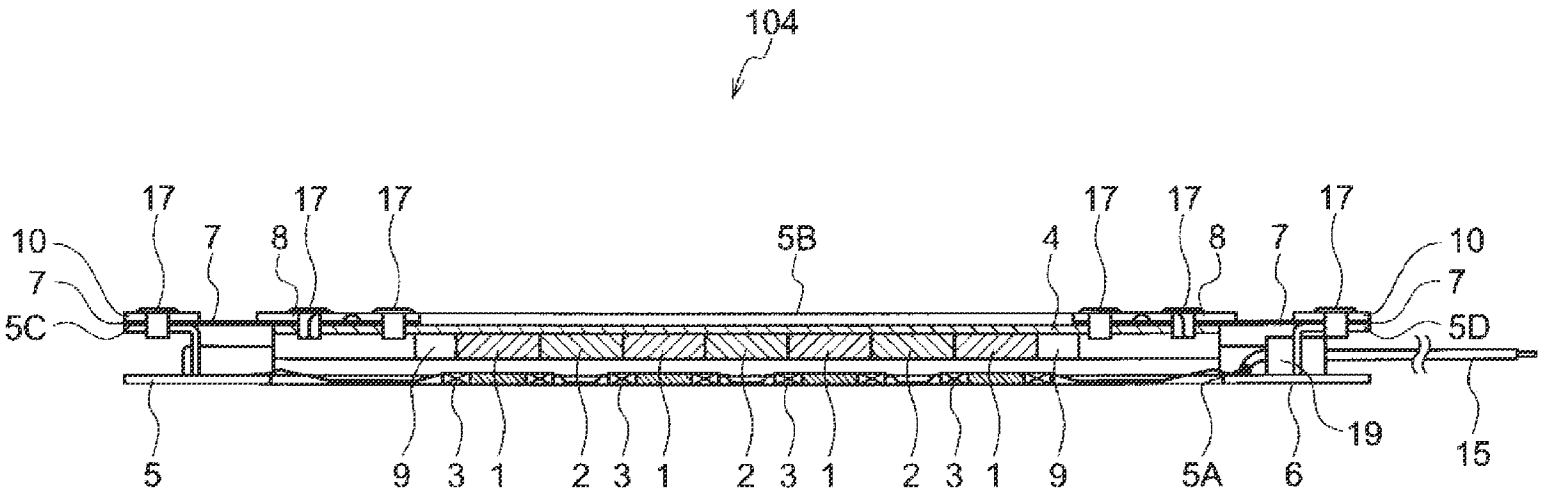
FIG. 14 is a sectional diagram showing an alternative example of a hybrid speaker in accordance with the third exemplary embodiment.

Instead of the structure as shown in FIG. 13 in which the other end portion of each plate spring 7 is fixed with the screws 12 in the state in which the other end portion of the plate spring 7 is nipped by the suspension block 16 and the plate spring holding member 10, a structure as shown in FIG. 14 is possible. In this structure, the spring member attachment portion 5C and spring member attachment portion 5D are formed at the upper face of the frame 5 and the other end portion of the plate spring 7 is fixed with the rivets 17 in a state in which the other end portion of the plate spring 7 is nipped by the plate spring holding member 10 and the spring member attachment portion 5C or spring member attachment portion 5D.

As shown in FIG. 13 and FIG. 14, the hybrid speaker 104 according to the third exemplary embodiment has a structure in which each plate spring holding member 8 protrudes from the end portion of the yoke 4 toward the other end portion of the plate spring 7. Therefore, deformations of the plate springs in the direction in which the yoke 4 moves upward in FIG. 13 and FIG. 14 are not impeded by the plate spring holding members 8, but deformations of the plate springs 7 in the direction in which the yoke 4 approaches the diaphragm 6 are suppressed by the plate spring holding members 8.

Therefore, even when large sound signals are inputted to the voice coils 3, contact between the magnets and the voice coils 3 and the production of abnormal noises can be prevented. Moreover, an air gap between the voice coils 3 and the first magnets 1 and second magnets 2 may be made smaller. Therefore, larger acoustic pressures can be provided even when sound signals of the same magnitude are inputted.

The foregoing description of the exemplary embodiments of the present invention has been provided for the Purpose of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The invention claimed is:

1. A hybrid speaker comprising:

first magnets that are arranged at predetermined intervals such that one of south poles or north poles thereof are oriented to the same side;

second magnets that have smaller volumes than the first magnets and that are arranged singly or in pluralities between the first magnets such that the magnetic poles thereof are oriented the opposite way to the first magnets and arranged such that the first and the second magnets are in contact with each other;

a yoke that accommodates the first and second magnets and that forms magnetic circuits with the first magnets;

a voice coil that is disposed so as to cross magnetic circuits between the first magnets and the second magnets and between the first magnets and the yoke;

a diaphragm, at one face of which the voice coil is fixed;

a frame, to which the diaphragm is fixed at periphery portions of the face at the side of the diaphragm at which the voice coil is fixed; and a yoke support member that resiliently supports the yoke on a face of the frame that is at the opposite side to the side on which the diaphragm is fixed.

2. The hybrid speaker of claim 1, wherein the first and the second magnets are arranged in a line.

3. The hybrid speaker according to claim 2, wherein the yoke support member is a plate spring of which one end is fixed to the yoke and the other end is fixed to the frame.

4. The hybrid speaker according to claim 3, wherein the plate spring is fixed to the yoke by the one end of the plate spring being nipped by a plate spring holding member and an end portion of the yoke, and the plate spring holding member is formed so as to protrude from the end portion of the yoke toward the other end portion of the plate spring.

5. The hybrid speaker according to claim 1, wherein a shape in plan view of the diaphragm is a high-order curve represented by the following expression in an X-Y coordinate system whose origin is a central point of the diaphragm:

$$r^i=|x|^i+|y|^i$$

in which r represents a radius and i represents an integer from 5 to 7.

6. The hybrid speaker according to claim 3, wherein a shape in plan view of the diaphragm is a high-order curve represented by the following expression in an X-Y coordinate system whose origin is a central point of the diaphragm:

$$r^i=|x|^i+|y|^i$$

in which r represents a radius and i represents an integer from 5 to 7.

7. The hybrid speaker according to claim 4, wherein a shape in plan view of the diaphragm is a high-order curve represented by the following expression in an X-Y coordinate system whose origin is a central point of the diaphragm:

$$r^i=|x|^i+|y|^i$$

in which r represents a radius and i represents an integer from 5 to 7.

* * * * *